US008258470B2

(12) United States Patent
Sheehan

(10) Patent No.: US 8,258,470 B2
(45) Date of Patent: Sep. 4, 2012

(54) RADIO FREQUENCY LENS FOR INTRODUCING IONS INTO A QUADRUPOLE MASS ANALYZER

(75) Inventor: Edward William Sheehan, Pittsburgh, PA (US)

(73) Assignee: Edward W Sheehan, Pittsburgh, PA (US)

( * ) Notice: Subject to any disclaimer, the term of this patent is extended or adjusted under 35 U.S.C. 154(b) by 451 days.

(21) Appl. No.: 12/653,449

(22) Filed: Dec. 14, 2009

(65) Prior Publication Data

US 2010/0288919 A1 Nov. 18, 2010

Related U.S. Application Data

(60) Provisional application No. 61/201,781, filed on Dec. 15, 2008.

(51) Int. Cl.
*H01J 49/42* (2006.01)

(52) U.S. Cl. ..... 250/292; 250/396 R

(58) Field of Classification Search ..... 250/292, 250/290, 281, 282, 396 R
See application file for complete search history.

(56) References Cited

U.S. PATENT DOCUMENTS

| | | | | |
|---|---|---|---|---|
| 3,129,327 | A | 4/1964 | Brubaker | |
| 3,371,204 | A | 2/1968 | Brubaker | |
| 3,555,271 | A | 1/1971 | Brubaker et al. | |
| 3,560,734 | A | 2/1971 | Barnett et al. | |
| 3,783,279 | A | 1/1974 | Brubaker | |
| 3,867,632 | A | 2/1975 | Fite | |
| 3,936,634 | A | 2/1976 | Fite | |
| 3,937,954 | A | 2/1976 | Fite | |
| 4,013,887 | A | 3/1977 | Fite | |
| 6,111,250 | A | 8/2000 | Thomson et al. | |
| 6,153,880 | A | 11/2000 | Russ, IV et al. | |
| 6,340,814 | B1 | 1/2002 | Vandermey | |
| 6,730,904 | B1 * | 5/2004 | Wells | 250/292 |
| 2010/0090104 | A1 | 4/2010 | Splendore et al. | |

OTHER PUBLICATIONS

Wollnik, H., et al, "The influence of magnetic and electric fringing fields on the trajectories of charged . . . ," Nucl. Instr. and Meth., 36, pp. 93-104 (1965). Elsevier, UK.

Wollnik, H., "Electronic prisms," In: Focusing of Charged Particles, Chap 4.1, pp. 171-173, (Septier, A., ed.) Academic Press: New York (1967).

Matsuda, et al., "Influence of fringing fields on image aberrations of double-focusing mass . . . ," Int. J. Mass Spectrom. Ion Phys., 6, pp. 365-392 (1971). Elsevier, UK.

* cited by examiner

*Primary Examiner* — Kiet T Nguyen

(57) ABSTRACT

An improved ion optical lens designed to increase the amount of ion current delivered into a multi-pole ion detector or transfer device, such as quadrupole mass analyzer, an ion guide, collision cell, etc. A device and method is disclosed that utilizes a tubular entrance lens to introduce ions into or sample ions at a field-free or near field-free region disposed at the junction of two sets of multi-pole assemblies operating with radio frequency potentials shifted 180 degrees out of phase with respect to each other. The method is useful for increasing the transport of ions into as they enter into or exit out of a multi-pole mass analyzer, such as a quadrupole mass analyzer, an ion guide, collision cell, etc.

20 Claims, 9 Drawing Sheets

RADIO FREQUENCY LENS FOR INTRODUCING IONS INTO A QUADRUPOLE MASS ANALYZER

CROSS-REFERENCE TO RELATED APPLICATIONS

This application claims the benefit of PPA Ser. 61/201,781, filed 2008 Dec. 15 by the present inventors.

GOVERNMENT SUPPORT

Not applicable.

SEQUENCE LISTING OF PROGRAM

Not applicable.

BACKGROUND OF THE INVENTION

1. Field of Invention

This invention relates to lenses for mass spectrometers, specifically to such lenses which are used at the entrances and exits of multi-pole assemblies with oscillatory and direct current potentials, such as quadruple mass spectrometers, multi-pole ion guides and collision cells, etc.

2. Prior Art

Quadrupole mass spectrometers commonly use an entrance lens in front of the quadrupole with a can or chamber encasing the quadrupole assembly to contain the oscillating fields of the quadrupole assembly inside of a metal can to prevent these fields from reaching out into the ion source region; detrimentally influencing the trajectories of ions. These fields at the entrance (and exit) of quadrupoles are commonly referred to as "fringe fields" and are composed of axially projected fields.

Originally entrance lenses where a flat plate with an aperture, referred to as a "shime or a diaphragm" (Steffen, 1965; Wollnick et al. 1965). However, this just prevented the fringe fields from entering the ion source. But as ions passed through the aperture, and were directed towards the quadrupole assembly, they were subjected to these fringe fields which lead to dispersing or defocusing the ion beam. Thereby, causing some ions to be lost (or rejected) and not enter the quadrupole assembly.

Thereafter, inventors disclosed several types of entrance lenses to introduce ions into a quadrupole assembly in such a way as to reduce these disperseive fields. U.S. Pat. Nos. 3,129,327 (1964), 3,371,204 (1968), 3,555,271 (1971), 3,783,279 (1974) all to Brubaker or Brubaker et al. disclosed a quadrupole assembly commonly referred to as a "pre-quad" disposed between the quadrupole mass spectrometer and the entrance lens. This pre-quad was relatively short compared to the quadrupole mass spectrometer and only powered with the RF electrical component or a derivative potential of the quadrupole mass spectrometer. Thereby, controlling the electrodes of the pre-quad to produce a decrease in the ratio of the static (DC, direct current) to the peak alternating potential (AC, alternating current)—delaying the onset of the DC component, with the ratio of DC to AC potential substantially zero at the inlet end of the quadrupole mass spectrometer.

Several types of entrance lens that are conical or tubular (snouts) shaped have been disclosed—for example U.S. Pat. No. 3,560,734 to Barnett et al. (1971), U.S. Pat. Nos. 3,867,632 (1975), 3,936,634 (1976), 3,937,954 (1976), and 4,013,887 (1977) all to Fite, and U.S. Pat. No. 6,153,880 to Russ IV et al. (2000). Barnett et al. disclosed an entrance lens comprised of two flat plates with conical (or tubular) snouts whose apexes are positioned inside the entrance of the quadrupole assembly an equal distance between each rod penetrating the fringe fields present at the entrance. When ions are accelerated through the lens into the central axis of the quadrupole mass analyzer they are shielded from these fringe fields. As the ions near the exit of the snout inside of or at the entrance to the quadrupole assembly they experience the defocusing effect of the fringe fields that are substantially reduced but still present.

Fite disclosed in a series of patents an entrance lens comprised of a flat metal plate with a dielectric tube (or snout) whose exit also is positioned inside the entrance region of the quadrupole assembly. The dielectric tube permitted the oscillatory fields from the quadrupole mass spectrometer to penetrate the tube thereby focusing the ions, as shown with the pre-quad by Brubaker, but block the defocusing direct current fields. The ions exit the tube in a similar fashion to the lens described above by Barentt et al. where the defocusing effect of the fringe fields are substantially reduced but still present Russ IV et al. disclosed an entrance lens that is conical in shape that penetrates slightly into the central axis of the quadrupole assembly where the voltage supply for the lens is phase coherent with the voltage applied to the mass filter allowing more ions to be transmitted through the lens and into the mass filter. But nevertheless all the lenses at the entrances of multi-pole assemblies heretofore known suffer from a number of disadvantages:

(a) Entrance lens such as "shims or diaphragms" do completely block these defocusing fringe fields upstream of the entrance lens but ions upon entering and passing through the aperture of the lens, and before entering the multi-pole assembly, experience defocusing fringe fields (both axially alternating and direct current fields) which lead to the lost of ions as they traversed the distance from the lens to the multi-pole assembly—before they enter the multi-pole assembly.

(b) The use of pre-quads eliminates the defocusing DC fringe fields at the entrance of the pre-quad (delays the DC fields) but the axially RF defocusing fields remain.

(c) Lens with a metal snout or tube only shield the ions while the ions are inside the snout, but as they near the exit of the tube they experience these fringe fields in an increasing manner and some of the ions are lost, impacting into the inside walls of the tube and onto the rods of the quadrupole analyzer after they exit.

(d) Lens with a metal plate and a dielectric snout offer some improvement, but as the ions pass from the flat metal plate into the dielectric tube they experience these axial oscillatory fields and are potentially lost to the inside walls of the dielectric tube. In addition, as charged and neutral material accumulate on the inside of the tube the dielectric nature of the tube changes requiring constant adjustment of the potential of the tube; and cleaning.

(e) Combining pre-quads with either a lens with a metal or dielectric snout doses not eliminate the axial oscillating defocusing fields as the ions exit the tubes.

(f) If the radio frequency phase of the quadrupole assembly is applied to the entrance lens, ions experience defocusing fields upstream of the entrance lens and are possibly lost before passing through the entrance lens and into the multi-pole assembly.

3. Objects and Advantages

Accordingly several objects and advantages of the present invention are:

(a) to provide entrance and exit lenses for a quadrupole mass analyzer which can cancel or neutralize the defocusing fringe fields present at the inlet and outlet of quadrupole mass analyzers;

(b) to provide an entrance lens which will allow a larger percentage of ions from an ion source to pass through the entrance lens and into the central axis of the quadrupole mass analyzer uninhibited;

(c) to provide an entrance and exit lenses for quadrupole mass analyzers which can replace existing lens;

(d) to provide lens whose production allows for the individual parts to easily removed, disassembled, cleaned, and reassembled;

(e) to provide an entrance and exit lens for a multi-pole collision cell which can restrict the flow of gas out of the collision cell into the surrounding vacuum chamber; and (f) to provide an exit lens from an high pressure multi-pole ion guide which can restrict the flow of gas out of the ion guide into the surrounding vacuum chamber.

Further objects and advantages are to provide a lens which can be easily installed and inexpensive to manufacture; which can be mass produced; can be comprised of metal, such as, stainless steel and insulating material, such as, Teflon or Vespel; which can be used with multi-pole assemblies such as a quadrupole mass analyzers, hexapole, octopole or quadrupole ion guides or collision cells; use with multi-plate ion guides or collision cells; as an exit lens for a multi-pole assembly; can replace entrance lens in electron ionization ion sources to quadrupole mass analyzers; and can be easily retrofitted to existing assemblies or instrumentation. Still further objects and advantages will become apparent from a consideration of the ensuing description and drawings.

SUMMARY

In accordance with the present invention a lens comprises a flat plate with an aperture and a snout, and a set of multi-poles with a radio frequency potential 180 degrees out of phase with an adjacent multi-pole assembly thereby creating a field-free or near field-free region where the two sets of multi-pole assemblies meet.

DRAWINGS

Figures

In the drawings, closely related figures have the same number but different alphabetic suffixes.

DRAWINGS

Reference Numbers

Figure 1:
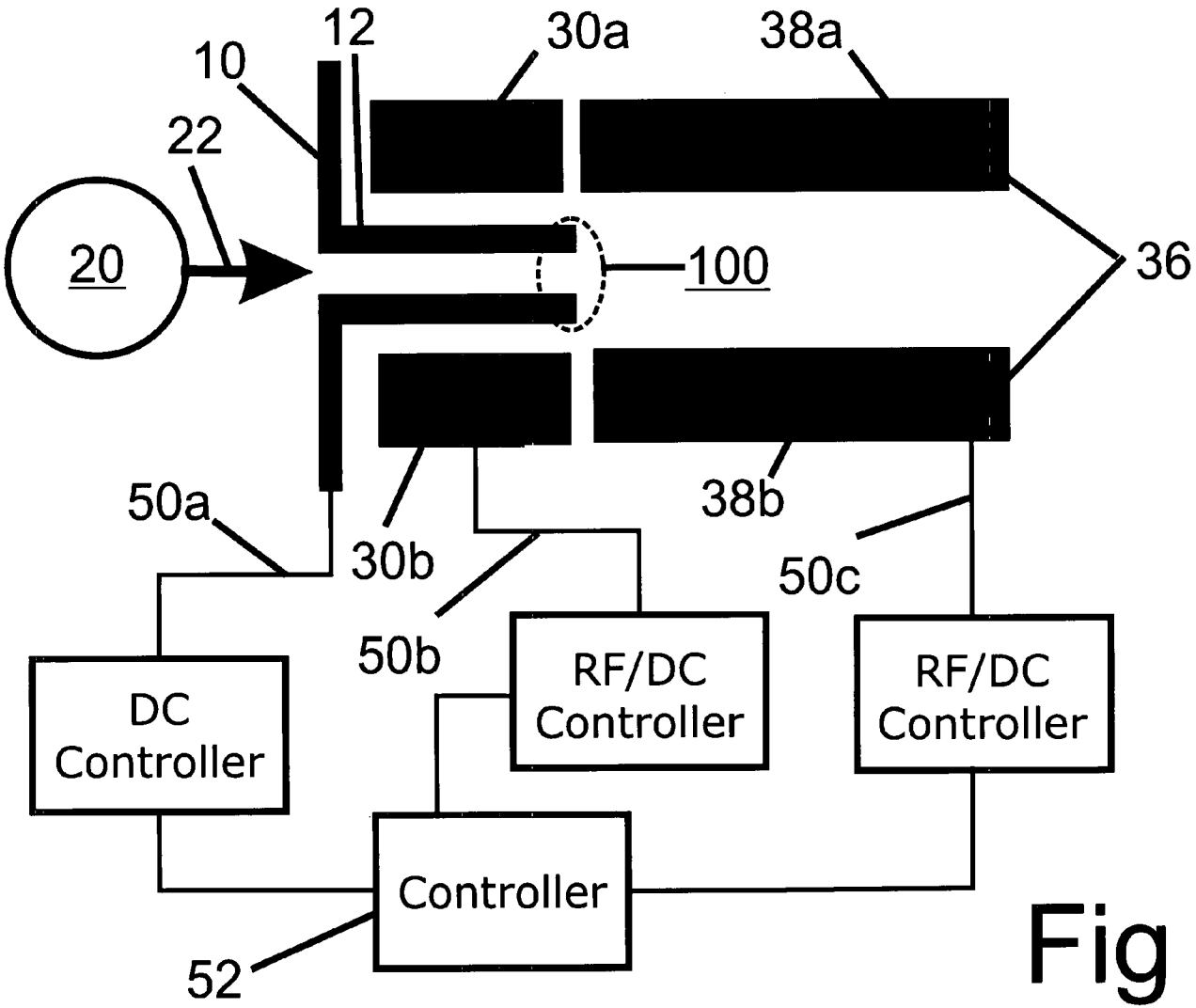
FIG. 1 shows a cross-sectional view of the inlet.

10 electrode or lens
11 tubular extension
12 snout
14 conical shape aperture
16 restriction or aperture
20 ion source region
22 incident in beam
30 poles
32 tubular shaped electrode
36 quadrupole mass analyzer
38 poles of the quadrupole mass analyzer
40 RF-only set of pre-quads
50 electric leads
52 controller
60 tubular lens
62 detector
100 region
102 exit lens
104 second lens assembly
200 entrance lens
201 entrance lens
202 exit lens
204 entrance lens
206 exit lens
210 hexa-pole assembly
220 RF collision cell

DETAILED DESCRIPTION

FIG. 1—Preferred Embodiment

A preferred embodiment of the present invention is an inlet or entrance lens assembly to a quadrupole RF/DC (radio frequency/direct current) mass analyzer, see FIG. 1, with an incident ion beam 22 directed from an ion source region 20 through the inlet into a quadrupole analyzer 36. This device is intended for use in collection, focusing, and introducing ions from low pressure ion sources, such as but not limited to, electron and chemical ionization sources, photo-ionization sources, etc.; ion optic assemblies that make up high pressure direct current (DC) and radio frequency (RF) collision cells; and ion optic assemblies (comprised of elements utilizing direct current (DC) and radio frequency (RF) potentials) that makeup the low pressure components of atmospheric or near-atmospheric pressure sources, such as but not limited to electrospray, atmospheric pressure chemical ionization, photo-ionization, laser desorption (including matrix desorption), inductively coupled plasma, and discharge ionization.

The inlet is comprised of an electrode or lens 10 and a set of four poles 30*a*, 30*b*, 30*c* (not shown), 30*d* (not shown), where the exits of the individual poles are adjacent to and symmetrically aligned with the corresponding poles 38*a*, 38*b*, 38*c* (not shown), 38*d* (not shown) of the quadrupole mass analyzer 36. The lens 10 may be formed from an aperture plate by adding a snout 12 for extending between the four poles 30*a*, 30*b*, 30*c* (not shown), 30*d* (not shown) of the lens along the central axis. The snout 12 is tubular in nature but may be conical or have an irregular cylindrical shape. The length of the snout depends on the length of the multi-pole assembly and the spacing between the individual poles 30 of the multi-pole assembly and the poles 38 of the mass analyzer 36. Typically, the individual poles 30*a*, 30*b*, 30*c* (not shown), 30*d* (not shown) of the lens are separated from the poles 38*a*, 38*b*, 38*c* (not shown), 38*d* (not shown) of the quadrupole analyzer 36 by an insulator or dielectric disk or rod (not shown). The snout 12 extends past the end of the multi-pole assembly plus ½ the distance separating the individual rods 30*a*, 30*b*, 30*c* (not shown), 30*d* (not shown) of the inlet from the rods 38*a*, 38*b*, 38*c* (not shown), 38*d* (not shown) that make up the quadrupole analyzer forming region 100. Typical distances separating the rods are 1-2 millimeters and are determined by the peak-to-peak potentials of the RF potentials and the DC potentials of the abutting/adjacent poles. This corresponds to region 100 being approximately 0.5 to 1 millimeter from the ends of the individual poles, respectively.

Electric leads 50*a*, 50*b*, 50*c* schematically depict the connections required to supply the lens with DC and RF potentials, along with leads supplying RF and DC potentials to the quadrupole mass filter. Both are controlled by and may output results to a controller 52. The RF potentials supplied the inlet are 180 degrees out-of-phase with the RF potentials supplied the quadrupole mass spectrometer.

Figure 2A:
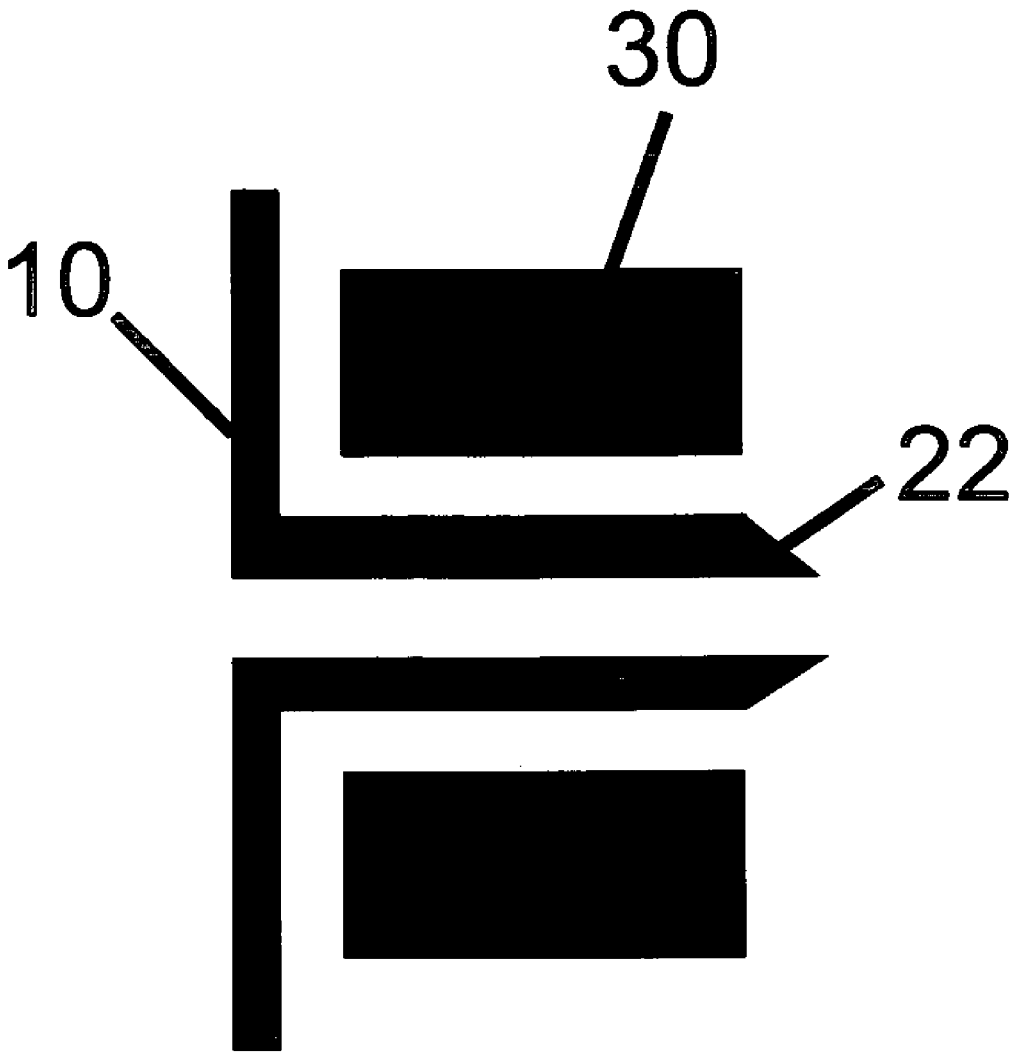
FIG. 2A show a cross-sectional view of the inlet with the shout of the lens with a cylindrical shape and an exit tapering-down into a conical shape, with the exit opening of the shout smaller than the entrance opening.
Figure 3:
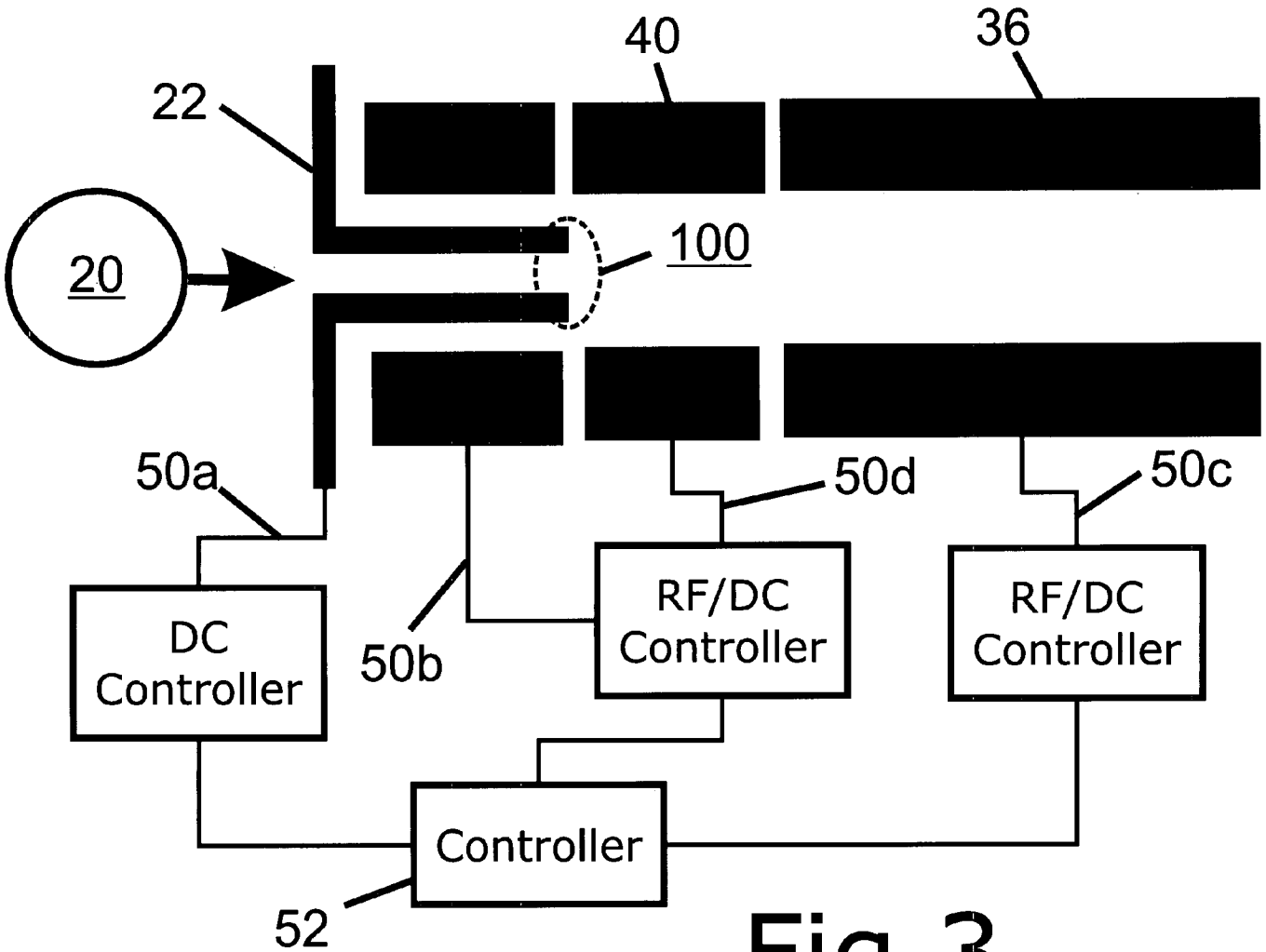
FIG. 3 show a cross-sectional view of the lens adjacent to a quadrupole mass analyzer comprised a set of pre-quads and an RF/DC qaudrupole mass filter.

FIGS. 2A, 2E, and 3

Additional Embodiments

Additional embodiments are shown in FIGS. 2 thru 3. In FIG. 2A the snout 12 of the lens is cylindrical shaped with a conical shaped aperture 14; in FIG. 2B the snout 12 is shown cylindrical shaped with a restriction or aperture 16 at the exit; in FIG. 2C a tubular extension 11 is added to the outer edge of the aperture plate 10; in FIG. 2D the multi-pole assembly is replaced with a ring or tubular shaped electrode 32. FIG. 3 illustrated the lens adjacent to a mass analyzer comprised of a RF-only set of pre-quads 40 and an RF/DC quadrupole mass analyzer 36 with corresponding electrical leads 50*a*, 50*b*, 50*c*, and 50*d*.

Figure 4:
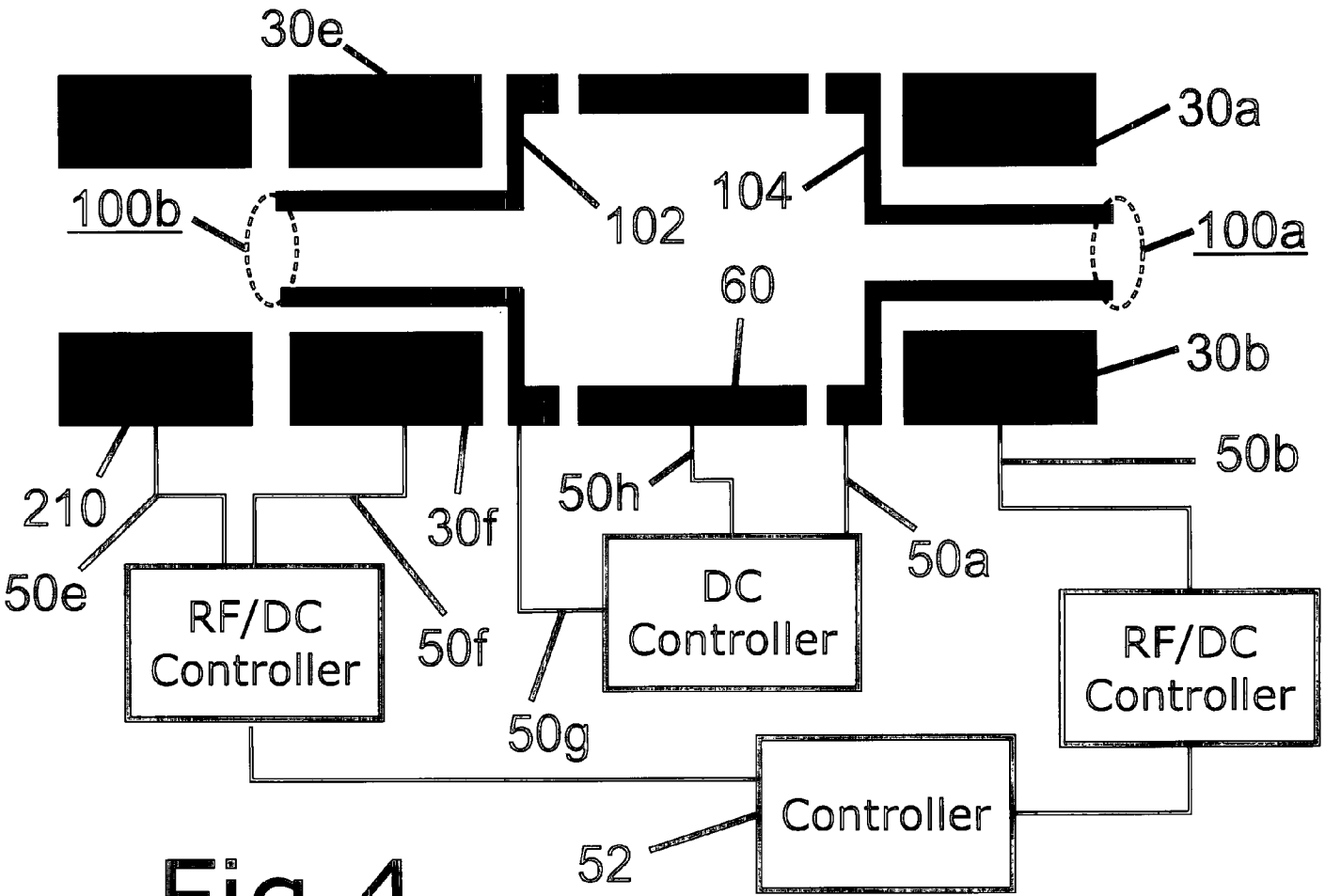
FIG. 4 shows a cross-sectional view of an ion guide assembly, comprised of a hexa-pole assembly, with the tens as an exit lens.

FIGS. 4 and 6

Alternate Embodiments

Figure 5A:
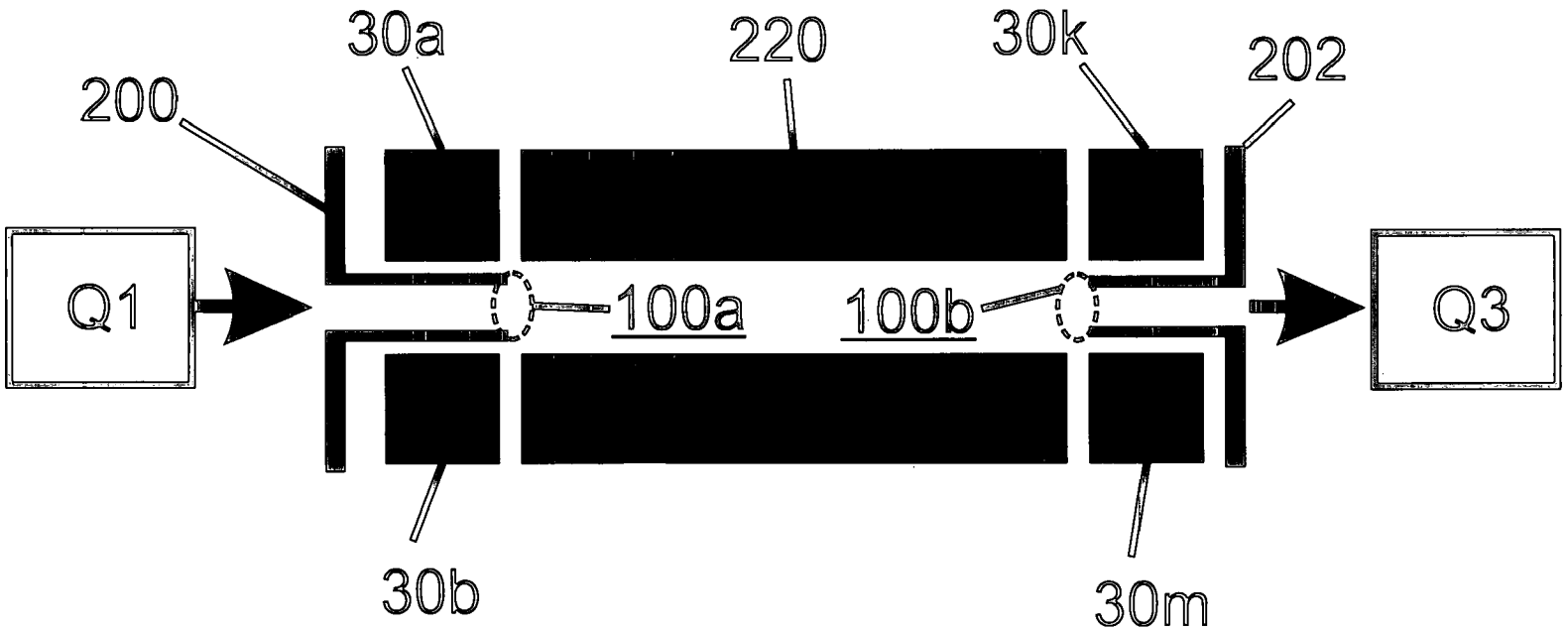
FIG. 5A shows a similar view of a multi-pole assembly with the lens as an entrance and exit lens of a high-pressure RF collision cell.
Figure 5B:
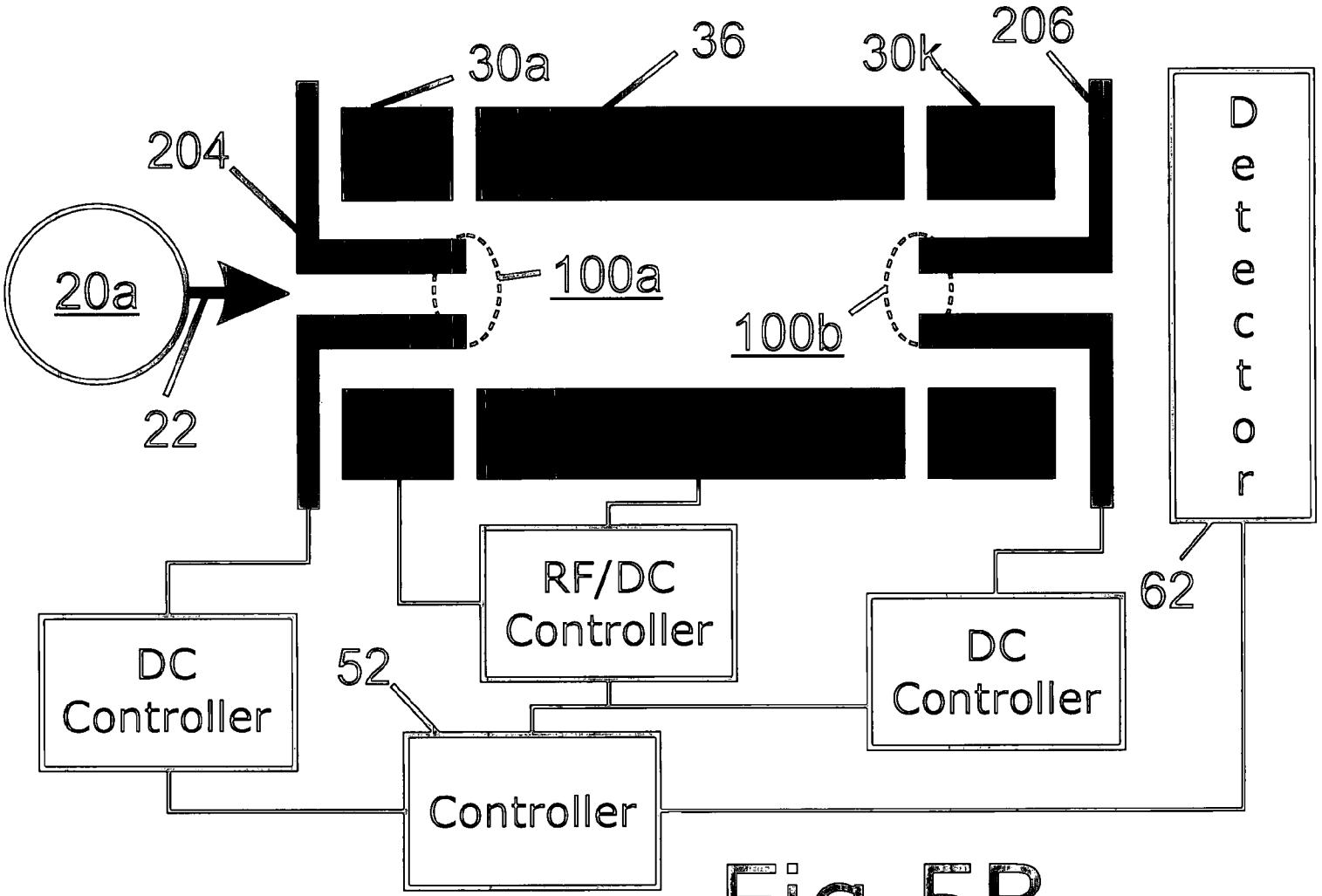
FIG. 5B shows a similar view with the lens as an entrance and exit lens of quadrupole mass analyzer.

There are various possibilities with regard to the relative disposition of the lens as illustrated in FIGS. 4-5. FIG. 4 illustrates an embodiment where the lens function as an exit lens 102 of an ion guide comprised of a hexa-pole assembly 210, utilizing direct current (DC) and radio frequency (RF) potentials. The multi-pole assembly of the lens are comprised of 6 poles 30*e*, 30*f*, 30*g* (not shown), 30*h* (not shown), 301 (not shown), 30*j* (not shown), with the individual poles axially aligned with their corresponding poles of the hexa-pole assembly. The lens is upstream of a tubular lens 60 leading into a second lens 104 assembly which leads into a quadrupole mass analyzer (not shown). The second lens is comprised of 4 poles 30*a*, 30*b*, 30*c* (not shown), 30*d* (not shown) where the individual poles are in turn axially aligned with the corresponding 4 poles of the mass analyzer. Corresponding electrical for the DC and RF controllers are shown 60*a*, 60*b*, 50*e*, 60*f*, 60*g*, and 50*h*. FIG. 5A illustrates the use of a set of lenses used as an entrance 200 and exit 202 lens to a high-pressure RF collision cell 220 comprised of a quadrupole assembly from a MS-MS analyzer, such as a triple quadrupole analyzer, comprised of upstream analyzer (Q1) and a downstream analyzer (Q3); a quadrupole-time-of-flight analyzer, etc. Alternatively, the inlet illustrated in FIG. 2D may be configured as an entrance and an exit lens of a collision cell or ion-guide assembly comprised of alternating plates. FIG. 5B illustrates the lens used both as an entrance 201 and exit 206 lens for a quadrupole mass analyzer with an electron ionization source 20*a* upstream of the entrance lens 204 and a detector 62 comprised of a dynode and electron multiplier downstream of the exit lens 206.

Operation

FIGS. 1 thru 5

The manner of using the inlet to introduce ions into a quadrupole mass spectrometer is similar to that for inlets in present use. Namely a potential difference is established between the ion source 20 and inlet. Ions are attracted to the inlet and enter the aperture 10 and are directed into and through the conduit. As the ions exit the conduit they are introduced into region 100. Region 100 is the region which is field-free or near field-free and is formed by the positioning the multi-poles adjacent to the corresponding poles of the quadrupole mass spectrometer and by supplying the multi-poles of the inlet with a RF potential 180 degrees out of phase with the corresponding pole of the mass spectrometer.

Figure 2B:
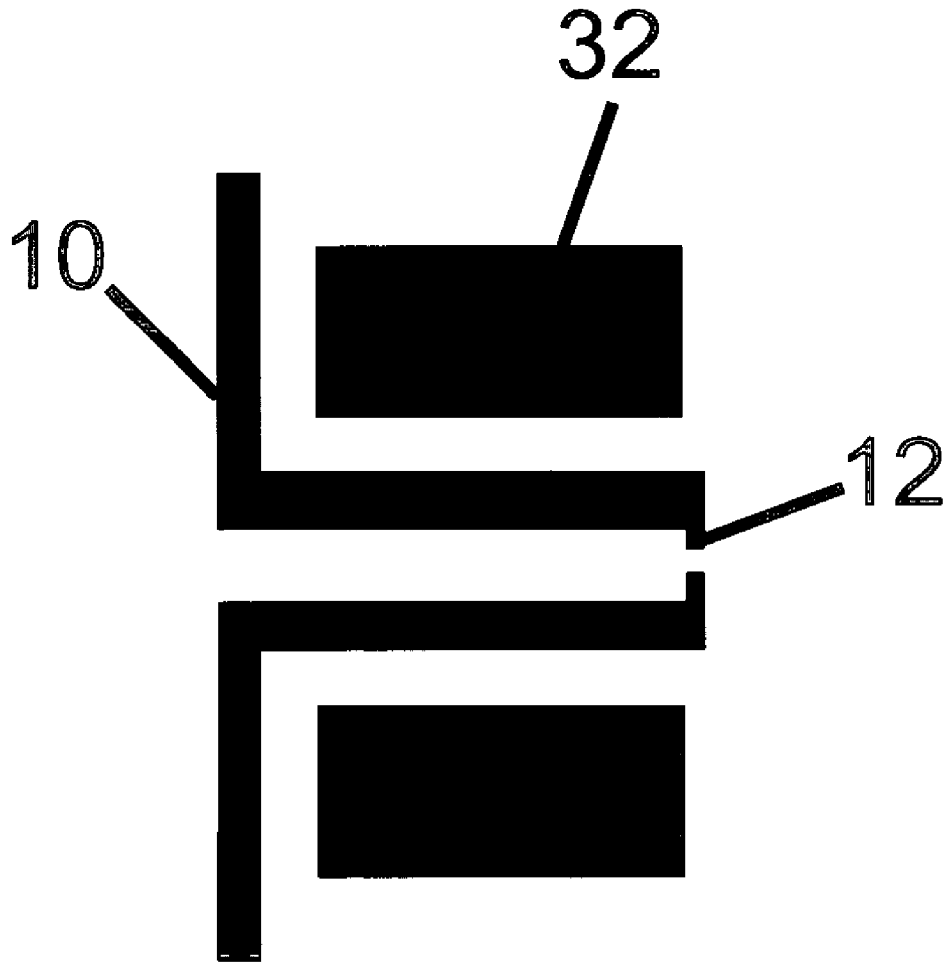
FIG. 2B show a similar view of the inlet with the shout of the lens with a cylindrical shape and restriction at the exit of the lens.
Figure 2C:
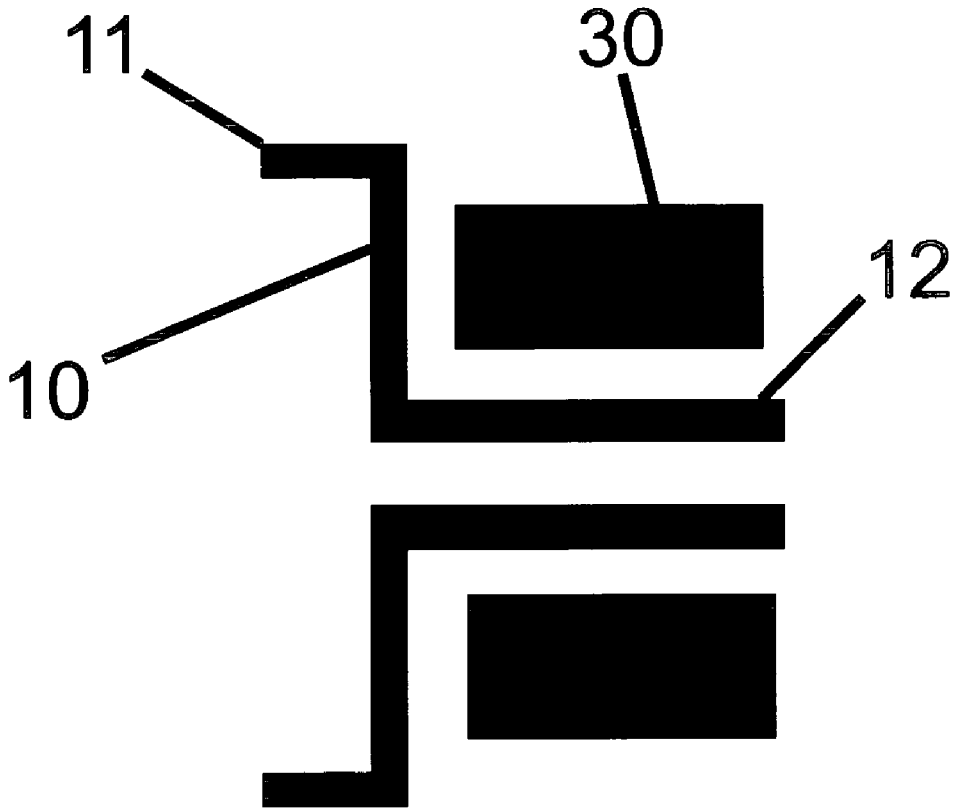
FIG. 2C shows a similar view of the inlet with aperture plate with a tubular lens on the outer edges of the plate.

The inlet can be used to restrict the flow of gas from the ion source into the quadrupole assembly by placing a restriction at the exit of the conduit, as shown in FIGS. 2A and 2B. This restriction can be formed tapering the ends of the conduit to form a conical shaped aperture 14 or alternatively a restriction 16 may be placed on the end of the conduit.

As shown in FIGS. 4 thru 5, when the inlet is used as an entrance 104, 200, 201 and exit lens 102, 202, 206, at the junction of the multi-poles, is field-free or near field-free, allowing the sampling of ions into the conduit in a field-free or near field-free regions 100.

Advantages

From the description above, a number of advantages of our lens assembly become evident:

(a) By placing the lens adjacent to the entrance to a quadrupole mass analyzer the defocusing fringe fields will be neutralized, and will permit the uninhibited passage of ions from an ion source through the lens and into the central axis of the quadrupole mass analyzer.

(b) By neutralizing the fringe fields present at the inlet the inside diameter of the snout can be larger, occupying more of the central axis of the quadrupole assembly and permit more ions to enter the quadrupole assembly.

(c) By having a similar footprint as existing entrance and exit lenses for quadrupole mass analyzers, the lenses can easily incorporated into existing instruments.

(d) The limited number of components and the nature of materials used to produce the individual parts, allows the lens to be easily removed, disassembled, cleaned, and reinserted back onto the can surrounding the multi-pole assembly or into the vacuum chamber wall adjacent the multi-pole assembly.

(e) By using the lens as an entrance and exit lens for a high pressure multi-pole collision cell the gas load imposed on the vacuum system can be reduced.

Figure 2D:
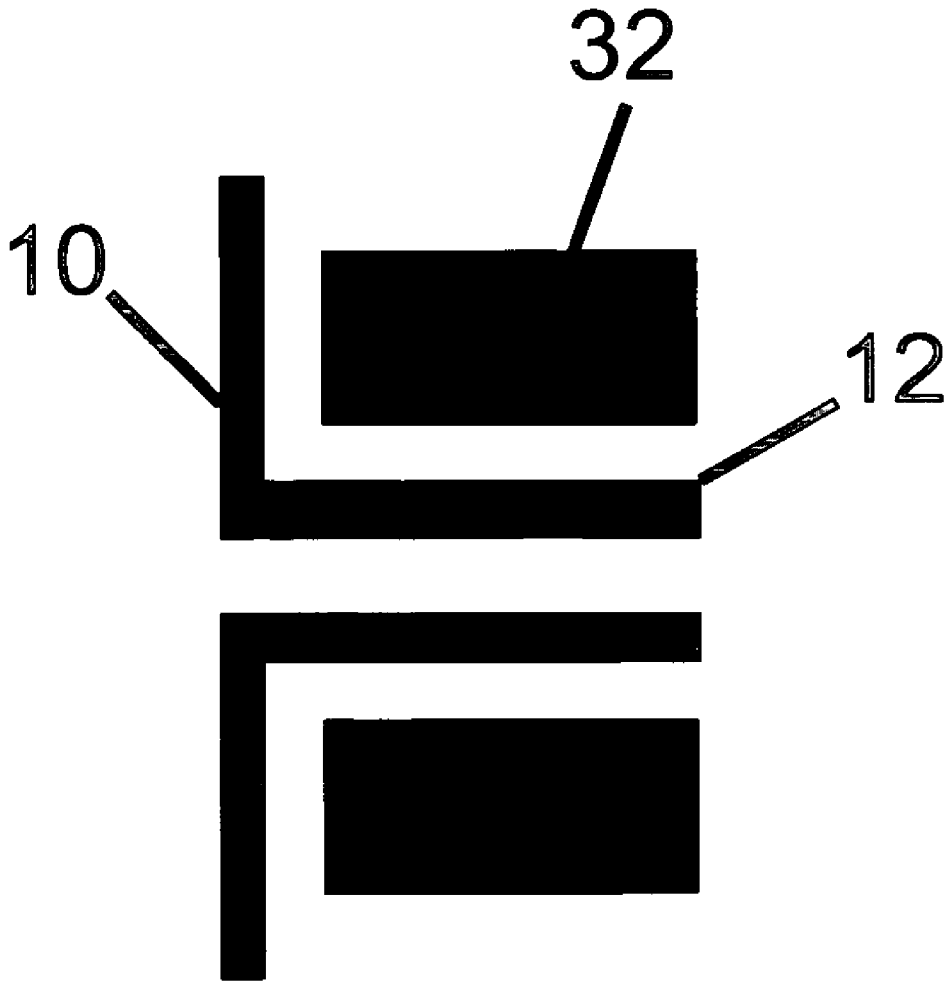
FIG. 2D shows a cross-sectional view of the inlet with a ring electrode.

FIGS. 2A and 2B show the exit of the snout with a tapered conical shape and a smaller opening than the entrance, respectively thereby restricting the flow of gas through the lens. FIG. 2D shows a similar lens with the multi-pole assembly replaced with a single ring for neutralizing the fields of an adjacent assembly comprised axially aligned ring or plate electrodes.

CONCLUSION, RAMIFICATION AND SCOPE

Accordingly, the reader will see that the lens of this invention once placed adjacent to the entrance or exit to a multi-pole assembly can be use to create a field-free or near field-free region at the junction of the lens and the multi-pole assembly; and a set of lens can be used between adjacent multi-pole assemblies—thereby neutralizing the defocusing fringe fields present at the entrance and exit of RF/DC and RF multi-pole devices. In addition, when a lens is placed adjacent to the entrance to a quadrupole mass analyzer with an electron ionization source, ions from the ion sources can be transferred from the ion source region into the central axis of the quadrupole mass analyzer without exposing the ions to the defocusing fringe fields. Furthermore, the lens has the advantages in that:

- it permits the introduction of a wider beam of ions into the central axis of the quadrupole mass analyzer;
- it provides entrance and exit lenses that can easily replace existing lens assemblies;
- it provides entrance and exit lenses which are easily and inexpensive to produce, clean, disassembled and reassembled;
- it provides entrance and exit lenses for a high pressure collision cell that determine the rate of gas flow from the cell into the vacuum chamber; and
- it provides an exit lens for a multi-pole ion guide to restrict the flow of gas out of the ion guide into the surrounding vacuum chamber.

Although the description above contains many specifications, these should not be construed as limiting the scope of the invention but as merely providing illustrations of some of the presently embodiments of this invention. For example, the lens can be incorporated into existing mass analyzers without the need to change the quadrupole assembly; the snout and aperture of the lens can have other symmetrical shapes, such as, a square shaped, oval shaped, etc.; the length of the individual rods of the lens' multi-pole assembly can be variable depending on the application; the multi-pole assembly can be composed of six or eight rods; the RF potential applied to the rods can be the same as or a derivative of the potential applied to the adjacent multi-pole assembly; the potentials, both direct and oscillatory, applied to the lens can be variable and either changed manually or by computer control; the potentials applied to the lens can track or mirror the potentials applied to the adjacent multi-pole assembly; the rods of the multi-pole assembly can have other shapes, such as, oval, square, rectangular, etc.; the rods can be solid or hollow; the rods can be oriented, such as, flat face to flat face for square or rectangular shaped rods, corner to corner for square shaped rods, etc.

Thus the scope of the invention should be determined by the appended claims and their legal equivalents, rather than by the examples given.

I claim:

1. A mass analyzer comprised of:

a. an ion source;

b. an inlet assembly having an input and an output;

c. a quadrupole mass analyzer assembly, said quadrupole mass analyzer assembly adjacent said inlet assembly;

d. an exit lens having an input and an output, said exit lens adjacent exit of said quadrupole mass analyzer assembly; and e. means for supplying electric potentials to said inlet assembly, said means supplying an electrostatic or direct current potential and an electrodynamic or radio frequency potential operating at least one frequency that is 180 degrees phase shifted with respect to a radio frequency potential applied to said quadrupole mass analyzer assembly;

whereby defocusing fringe fields at the entrance to said quadrupole mass analyzer assembly are cancelled out by the formation of a field free or near-field free region at the intersection of, or midpoint between, said output of said inlet assembly and input of said quadrupole mass analyzer assembly, allowing substantially all gas-phase ions from said ion source to be urged by said electric potentials means into and through said inlet assembly, passing uninhibited through said intersection and directed into said quadrupole for mass analysis and detection.

2. The mass analyzer of claim 1, wherein said ion source is comprised of an electron or a chemical ionization source with optical lenses; a collision or reaction cell; a second quadrupole mass analyzer; a two-dimensional or linear ion trap and mass analyzer; a low or high pressure ion or differential mobility analyzer; an ion guide, comprised of at least four axially aligned rods, plates, or bars with an exit lens or aperture upstream of said inlet assembly; an ion guide, comprised of a multi-pole assembly with an exit lens or aperture upstream of said inlet assembly, as part of an atmospheric pressure interface for electrospray, atmospheric pressure chemical ionization, discharge, photo-ionization, or a matrix assisted laser desorption ion source; and combination thereof.

3. The mass analyzer of claim 1, wherein said inlet assembly is comprised of a relatively flat plate with an aperture in communication with a conduit having a cylindrical shape, and four rods axially align with and surrounding said conduit, the distal end of said conduit extending past the distal ends of said four rods into said field free or near-field free region;

whereby said flat plate and conduit are supplied with said electrostatic potential while said rods are supplied with a combination of said electrostatic and said phase shifted radio frequency potential.

4. The mass analyzer of claim 1, wherein said quadrupole mass analyzer is further comprised of a pre-quad assembly, a post-quad assembly, high pressure collision cell, a second mass analyzer, and combination thereof.

5. The mass analyzer of claim 1, wherein said exit lens is comprised of a second relatively flat plate with an aperture in communication with a second conduit having a cylindrical shape and a second assembly of four rods axially align with and surrounding said second conduit, said exit lens coupled with a second means for supplying electrical potentials, said second means supplying an electrostatic electric potential to said second flat plate and second conduit and a radio frequency potential that is 180 degree phase shifted with respect to said radio frequency potential applied to said quadrupole mass analyzer to said second assembly of four rods, or a combination of a direct current and said phase shifted radio frequency potentials supplied from said second means for supplying electrical potentials;

wherein a second field-free or near field-free region is formed at the intersection of said output of said quadrupole mass analyzer assembly and input of said conduit of said exit lens at approximately the midway point between the ends the four rods of said quadrupole mass analyzer assembly and said four rods of said second assembly, whereby substantially all ions exiting said quadrupole mass analyzer assembly pass uninhibited through said field-free region, into and through said second conduit, and exiting said second plate to be detected or further analyzed.

6. The mass analyzer of claim 5, wherein said means for supplying said exit lens with said second electric potentials further includes means for varying said second electrostatic potential with mass.

7. The mass analyzer of claim 1, wherein said means for supplying said inlet assembly with electric potentials further includes means for varying said direct current potential with mass.

8. An entrance lens for neutralizing fringe fields at the entrance off a radio frequency ion transfer device, comprising:

a. said ion transfer device which is comprised of at least 2 poles, plates, or bars axially or symmetrically aligned;

b. a means for supplying individual poles or plates of said ion transfer device with a first electrodynamic or radio frequency potential or a combination of a first electrostatic or direct potential and said first radio frequency potential;

c. said entrance lens which is comprised of a relatively flat plate with an aperture leading to a conduit having a cylindrical shape and an electrode assembly axially aligned with and disposed symmetrically about said conduit;

d. means for supplying said plate and conduit of said entrance lens with a second electrostatic or direct current potential; and e. means for supplying said electrode assembly with a second electrodynamic or radio frequency potential that is 180 degrees phase shifted with respect to said first radio frequency potential, or a combination of a third electrostatic or direct potential and said phase shifted second radio frequency potential;

wherein when said lens is place adjacent to and upstream the entrance of said ion transfer device, individual electrodes of said electrode assembly are axially aligned with corresponding downstream said poles or plates of said ion transfer device, neutralizing or canceling the fringe fields present at entrance to said ion transfer device thereby creating a field free or near-field free region at the intersection of or midpoint between the exit of said entrance lens and said entrance of said ion transfer device, so that substantially all ions from an ion source can pass through said conduit and are focused into said ion transfer device, minimally influenced by the defocusing effects of said fringe fields.

9. The entrance lens of claim 8, wherein said ion source includes an electron or a chemical ionization source with optical lenses; a collision cell; a second quadrupole mass analyzer; a two-dimensional ion trap and mass analyzer; a low or high pressure ion or differential mobility analyzer; an ion guide, comprised of at least four axially aligned rods, plates, or bars; an ion guide, comprised of a multi-pole or multi-plate assembly, as part of an atmospheric pressure interface for electrospray, atmospheric pressure chemical ionization, discharge, photo-ionization, or a matrix assisted laser desorption ion source; and combination thereof.

10. The entrance lens of claim 8, wherein said ion transfer device is comprised of a quadrupole or a two-dimensional ion trap mass analyzer for mass analysis and detection; a multi-pole collision cell comprised of at least four rods; an ion guide or collision cell comprised of rods, plates, or bars; or an ion or differential mobility analyzer comprised of rods, plates, or bars.

11. The entrance lens of claim 8, wherein said electrode assembly, axially aligned with and disposes symmetrically about said conduit, is comprised of, a. at least four metal rods, plates, or bars, and when placed adjacent to said ion transfer device, individual metal rods of said electrode assembly are axially aligned with the corresponding individual poles, plates or bars of said ion transfer device;

b. a flat electrode with an aperture, said conduit projects through said flat electrode, and when placed adjacent to said ion transfer device is axially aligned with the corresponding individual plates of said ion transfer device; or c. two parallel metal plates, and when placed adjacent to said ion transfer device individual metal plates of said electrode assembly are axially aligned with the corresponding plates of said ion transfer device.

12. The entrance lens of claim 8, further including an exit lens adjacent exit of said ion transfer device, said exit lens comprised of a second relatively flat plate with an aperture in communication with a second conduit having a cylindrical shape and a second assembly of four rods axially align with and surrounding said second conduit, said exit lens coupled with a third means for supplying electrical potentials, said third means supplying an electrostatic electric potential to said second flat plate and second conduit and a radio frequency potential that is 180 degree phase shifted with respect to said radio frequency potential applied to said ion transfer device to said second assembly of four rods, or a combination of a direct current and said phase shifted radio frequency potentials supplied from said second means for supplying electrical potentials;

wherein substantially all said ions as they exit said ion transfer device pass through a field-free or near field-free region created at the intersection of the exit of said ion transfer device and the entrance to said second conduit, passing uninhibited into and through said second conduit and are transferred downstream of said exit lens.

13. The entrance lens of claim 12, where said third means for supplying electrical potentials to said exit lens further includes means for varying said electrostatic potential with mass.

14. The entrance lens of claim 8, wherein said second electrostatic potential supplied to said entrance lens further includes means for varying said electrostatic potential with mass.

15. A method for introducing ions into a quadrupole mass analyzer, comprising:

a. providing a source of ions;

b. providing an entrance lens to said quadrupole mass analyzer of the type comprising a flat plate having an aperture in communication with a conduit, and four rods axially aligned with and disposed symmetrically surrounding said conduit;

c. providing said flat plate and conduit with a first electrostatic potential;

d. providing said rods of said entrance lens with a radio frequency potential that is 180 degrees phase shifted with respect to a radio frequency potential applied to the corresponding four rods of said quadrupole mass analyzer or a combination of a second electrostatic potential and said phase shifted radio frequency potential; and e. cancelling defocusing fringe fields present at the entrance to said quadrupole mass analyzer by placing said entrance lens adjacent to the entrance of said quadrupole mass analyzer with individual rods of said lens axially aligned with and in close proximity with the corresponding rods of said quadrupole mass analyzer, thereby creating a field-free or near field-free region at the intersection of the exit of said entrance lens and entrance to said quadrupole mass analyzer, whereby substantially all said ions from said source are introduced through said entrance lens and directed into said quadrupole mass analyzer for mass analysis, uninhibited from said fringe fields.

16. The method of claim 15, wherein said ion source provides ions to said entrance lens from an electron or chemical ionization source; a high-pressure or low pressure collision cell; a second quadrupole mass analyzer; a two-dimensional or linear ion trap and mass analyzer, a low or high pressure ion or differential mobility analyzer; an ion guide, comprised of at least four axially aligned rods, plates, or bars; an ion guide as part of an atmospheric pressure interface for electrospray, atmospheric pressure chemical ionization, discharge, photoionization, or a matrix assisted laser desorption ion source; or combination thereof.

17. The method of claim 15, where said first electrostatic potential supplied to said entrance lens further includes means for varying said electrostatic potential with mass.

18. The method of claim 15, further comprised of an exit lens of the type comprising a second relatively flat plate with an aperture in communication with a second conduit having a cylindrical shape and a second assembly of four rods axially aligned with and surrounding said second conduit, said exit lens provided with a second means for supplying electrical potentials, said second means supplying an electrostatic electric potential to said second flat plate and second conduit and a radio frequency potential that is 180 degree phase shifted with respect to said radio frequency potential applied to said quadrupole mass analyzer to said second assembly of four rods, or a combination of a direct current and said phase shifted radio frequency potentials supplied from said second means for supplying electrical potentials;

whereby substantially all said ions as they exit said quadrupole mass analyzer pass through a field-free or near field-free region created at the intersection of the exit of said quadrupole mass analyzer and the entrance to said second conduit, passing uninhibited into and through said second conduit and are detected.

19. The method of claim 18, wherein said second electrostatic potential supplied to said exit lens further includes means for varying said electrostatic potential with mass.

20. A method for neutralizing fringe fields associated with radio frequency multi-pole or multi-plate ion transfer devices permitting substantially all ions from an ion source to pass into, through and exit said radio frequency multi-pole or multi-plate ion transfer devices by:

a. placing an entrance lens adjacent to said multi-pole ion transfer device of the type comprising a first flat plate having a first aperture in communication with a first conduit, and a first plurality of poles or plates axially aligned with and disposed symmetrically surrounding said first conduit, the number of said poles or plates of said entrance lens equal to the number of poles of said radio frequency multi-pole ion transfer device, providing said first flat plate and first conduit with a first electrostatic potential, providing individual poles or plates of said entrance lens with radio frequency or electrodynamic potentials that are 180 degrees phase shifted with respect to the radio frequency potential applied to individual poles or plates of said multi-pole ion transfer device or a combination of a second electrostatic potential and said phase shifted radio frequency potential, creating a first field-free or near field-free region at the intersection of the exit of said entrance lens and entrance to said multi-pole ion transfer device;

b. placing an exit lens adjacent the exit of said multi-pole transfer device of the type comprising a second flat plate having a second aperture in communication with a second conduit, and a second plurality of poles or plates axially aligned with and disposed symmetrically surrounding said second conduit, the number of said poles or plates of said exit lens equal to the number of poles of said multi-pole ion transfer device, providing said second flat plate and second conduit with a second electrostatic potential, providing individual poles or plates of said exit lens with radio frequency or electrodynamic potentials that are 180 degrees phase shifted with respect to the radio frequency potential applied to individual poles or plates of said multi-pole ion transfer device or a combination of a second electrostatic potential and said phase shifted radio frequency potential creating a second field-free or near field free region at the intersection of the exit of said multi-pole ion transfer device and entrance of said exit lens.

* * * * *